US005098542A

United States Patent [19]

Reinhardt et al.

[11] Patent Number: 5,098,542

[45] Date of Patent: Mar. 24, 1992

[54] CONTROLLED PLATING APPARATUS AND METHOD FOR IRREGULARLY-SHAPED OBJECTS

[75] Inventors: Paul A. Reinhardt; René R. Plascencia, both of Houston, Tex.

[73] Assignee: Baker Hughes Incorporated, Houston, Tex.

[21] Appl. No.: 580,826

[22] Filed: Sep. 11, 1990

[51] Int. Cl.[5] ..... C25D 17/00

[52] U.S. Cl. ..... 204/194; 204/297 W

[58] Field of Search ..... 204/23, 194, 297 W

[56] References Cited

U.S. PATENT DOCUMENTS

| | | | |
|---|---|---|---|
| 1,700,178 | 1/1929 | Porzel | 204/279 |
| 3,671,405 | 6/1972 | Mattia | 204/4 |
| 3,962,047 | 6/1976 | Wagner | 204/15 |
| 4,259,166 | 3/1981 | Whitehurst | 204/279 |
| 4,280,882 | 7/1981 | Hovey | 204/15 |
| 4,323,433 | 4/1982 | Loch | 204/279 |
| 4,534,832 | 8/1985 | Doiron, Jr. | 204/15 |
| 4,659,466 | 4/1987 | Shafer et al. | 204/212 |

FOREIGN PATENT DOCUMENTS

| | | |
|---|---|---|
| 563435 | 11/1932 | Fed. Rep. of Germany . |
| 255736 | 7/1926 | United Kingdom . |
| 1169225 | 10/1969 | United Kingdom . |

*Primary Examiner*—T. M. Tufariello

*Attorney, Agent, or Firm*—Price, Gess & Ubell

[57] ABSTRACT

An electroplating shield for providing controlled electroplating of an article having an irregular surface of crests and valleys. The shield, being made of a nonconductive material such as chlorinated polyvinylchloride, includes at least one aperture that spatially corresponds to the valleys of the article to be plated. A remote alignment fixture may be used to precisely align the shield apertures with the article valleys. Alternatively, a plurality of threaded alignment holes may be interspersed between a plurality of shield apertures, alignment being accomplished by threading a plurality of alignment screws through the threaded alignment holes and into the article valleys. A cylindrical embodiment of the electroplating shield having at least one spiralling aperture, is particularly suited for uniform plating of a spiral lobe rotor.

18 Claims, 6 Drawing Sheets

CONTROLLED PLATING APPARATUS AND METHOD FOR IRREGULARLY-SHAPED OBJECTS

BACKGROUND OF THE INVENTION

1. Field of the Invention

The present invention relates generally to electroplating and, more particularly, to an important method and apparatus for providing plating on the crests and valleys of an irregular target member.

2. Description of Related Art

A layer of metal is deposited on a manufactured article to enhance its aesthetics or increase its durability. Durability and low frictional characteristics are the primary concerns when the manufactured article will make frictional contact with other surfaces during use. An example of such an article is the spiral lobe rotor used in a downhole drilling motor that operates under the Moineau progressive cavity principal. The crests and valleys of the spiral lobe rotor make periodic sliding contact with the stator in a highly abrasive fluid. To prolong rotor life, it is necessary to plate the rotor with a material having low friction and good durability characteristics.

The prior art methods of electroplating irregular surface articles, such as the above-described spiral lobe rotor, have proved unsatisfactory in that the thickness of the plated material varies from crest to valley. In general, the crests are plated with more metal than the valleys. The prior art techniques sometimes yield a crest-to-valley thickness ratio as high as 8 to 1.

Premature rotor failure results from uneven plating because the relatively thin plating on the rotor valleys will wear away before the plating on the rotor crests. Moveover, increasing the plating time in order to provide adequate valley plating results in excessive crest plating, making it extremely difficult to accurately fit the rotor with the stator. Additionally, the stator cores around which the rubber elements of a Moineau system are injected can be better modified for better fit by using the controlled deposition method of the invention.

SUMMARY OF THE INVENTION

The present invention is directed toward resolving the above problems. In particular, the present invention provides a method and apparatus for controlled plating of the crests and valleys of an article such as a spiral lobe rotor. The method of electroplating such an article comprises the steps of connecting the target member to the negative terminal of a d.c. voltage source, connecting at least one anode to the positive terminal of the voltage source, and interposing a nonconductive shield having apertures thereon substantially corresponding to the valleys of the target member.

In accordance with the present invention, an electroplating shield for coating a target having a plurality of crests and valleys is comprised of a nonconductive mask member having at least one aperture therein spatially corresponding to the valleys of the target and means for aligning and holding fast, throughout the plating process, the spatial relationship between said mask and said target.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a method and apparatus for providing uniform electroplating of an article having an irregular surface.

Figure 1:
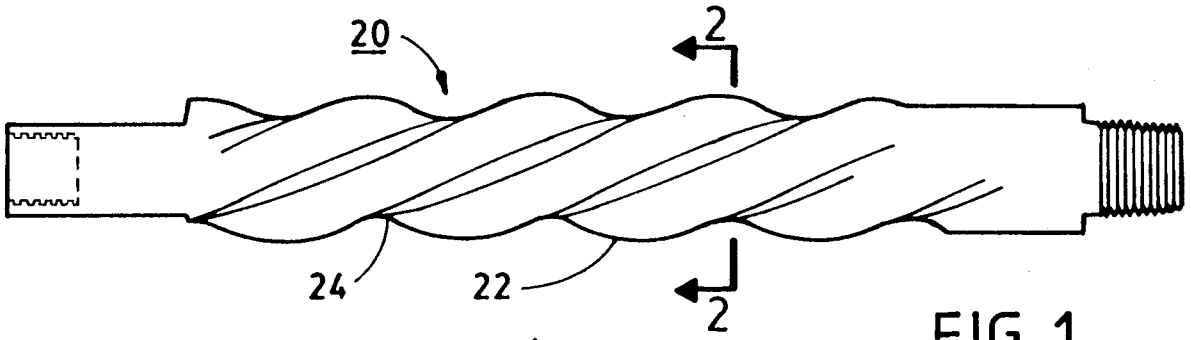
FIG. 1 is an elevation of a five-lobe spiral lobe rotor to be coated in accordance with the present invention.
Figure 2:
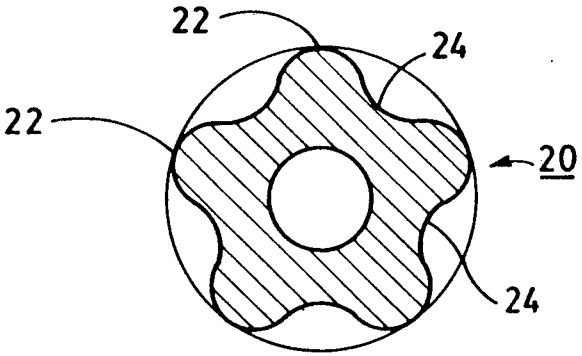
FIG. 2 is a sectional view, taken along line 2—2, of the rotor of FIG. 1.

Referring to FIGS. 1 and 2, a five-lobe spiral rotor 20 is shown having a plurality of alternating crests 22 and valleys 24 that spiral in parallel with one another about the longitudinal axis of the rotor 20.

The rotor 20 of FIGS. 1 and 2 is typically used as part of a downhole motor for earth drilling. For purposes of the present invention, it is sufficient to understand that the rotor 20 is encased within a stator housing (not shown) having internal spiralling lobes which roughly correspond to the crests 22 of the rotor, so as to define drive cavities therebetween. The rotor 20 is caused to rotate within the stator housing by remotely pumping a high pressure fluid into the drive cavities from one end of the assembly.

Because the rotor crests 22 and valleys 24 make sliding contact with the interior portion of the stator housing, it is important to plate the rotor 20 with a durable and low friction material. A hard chrome plating of about 0.008 to 0.020 inch is preferable.

Figure 9:
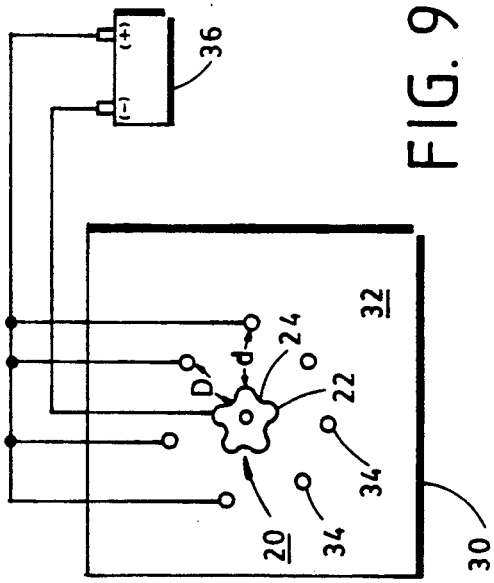
FIG. 9 is a schematic representation of a prior art electroplating process.

An electroplating system is schematically shown in FIG. 9. The rotor 20 is immersed in an electrolyte solution 32 carried by a tank 30. The rotor 20 is electrically connected to the negative (−) terminal of current source 36. A plurality of rod-shaped anodes 34 are connected to the positive (+) terminal of the current source 36 and arranged in the electrolyte solution 32 around the rotor 20. This apparatus provides less chrome to the valleys 24 than to the crests 22 because the distance "D," separating the valleys from the anodes 34, is greater than the distance "d" which separates the crests 22 from the anodes 34.

Figure 7:
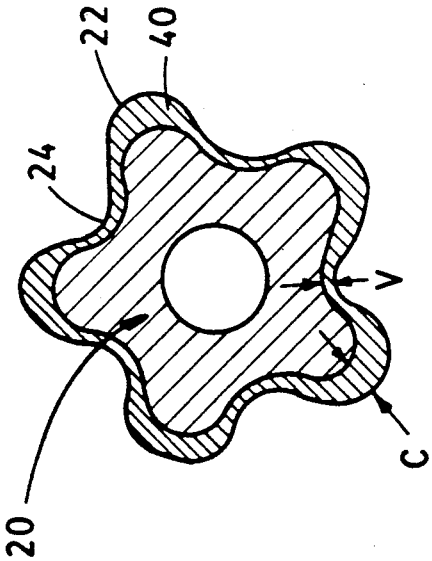
FIG. 7 is a sectional view showing the prior art variation in plating thickness, somewhat exaggerated, from crest to valley.

The result is uneven deposition on the crests 22 and valleys 24, as shown in FIG. 7 in a somewhat exaggerated fashion. As shown, the chrome plating is considerably thicker on the crests 22 than in the valleys 24. Valley plating thicknesses, "V" may be as small as 0.0015-inch and crest plating thicknesses, "C" may be as large as 0.025-inch.

Uneven plating results in uneven wear, shortens rotor life, and increases production time and cost because of the inherent difficulty in designing and fitting the unpredictable size rotors 20 to the uniformly sized stators.

The present invention provides an electroplating shield 10 that resolves these problems in a simple, and cost and time expedient fashion. The electroplating shield 10 is preferably made of a nonconductive material such as chlorinated polyvinylchloride (CPVC), for example, or a similar higher temperature nonconductive material.

Figure 3:
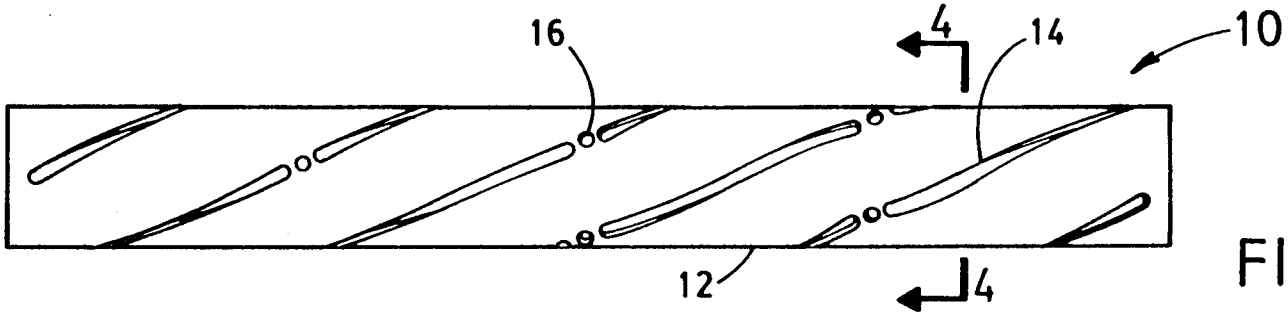
FIG. 3 is an elevational view of a preferred embodiment of an electroplating shield according to the present invention.
Figure 4:
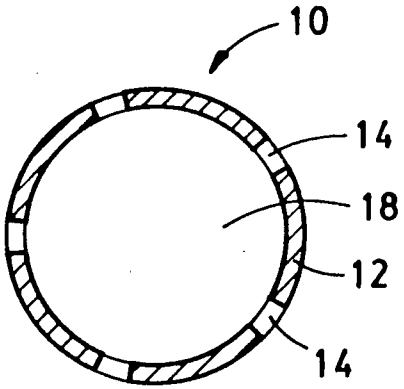
FIG. 4 is a sectional view, taken along line 4—4, of the shield of FIG. 3.
Figure 8:
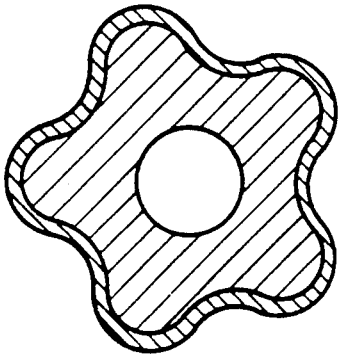
FIG. 8 is a sectional view showing the controlled plating thickness resulting from the present invention.

Referring to FIGS. 3 and 4, the shield 10 has an elongated cylindrical wall portion 12 which defines a longitudinal hollow 18. As suggested by FIG. 5, the shield wall 12 carries a plurality of slots 14 that spiral end-to-end in substantial correspondence to the spiral path of the rotor valleys 24.

The shield may further include a plurality of apertures 16 located between respective end-to-end pairs of slots 14. The apertures 16 (FIG. 5) are preferably threaded at the top and bottom to receive respective alignment screws.

Figure 6:
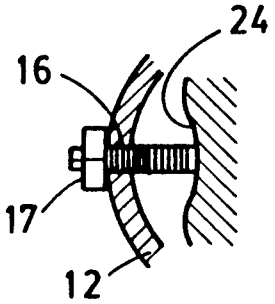
FIG. 6 is a sectional view, taken along line 6—6 of FIG. 5, of an alignment fixture according to the present invention.
Figure 5:
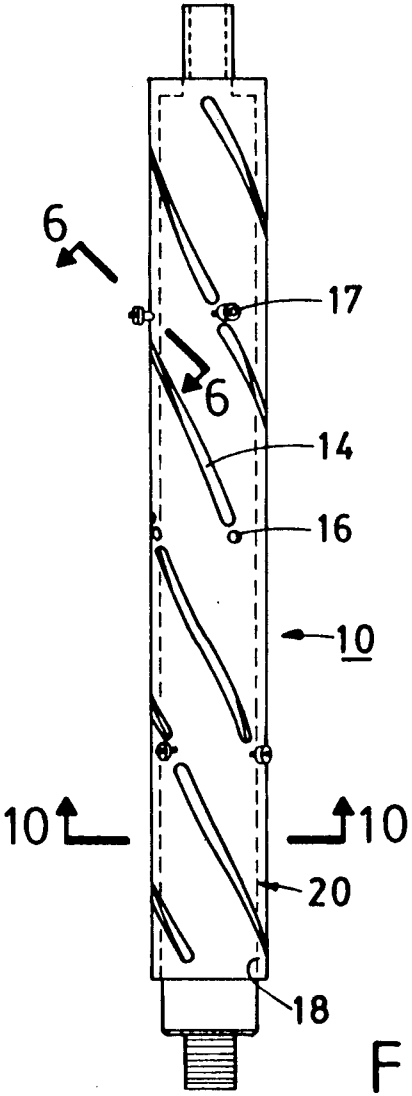
FIG. 5 is an elevational view of an electroplating shield according to the present invention placed concentrically around the rotor of FIGS. 1 and 2.
Figure 10:
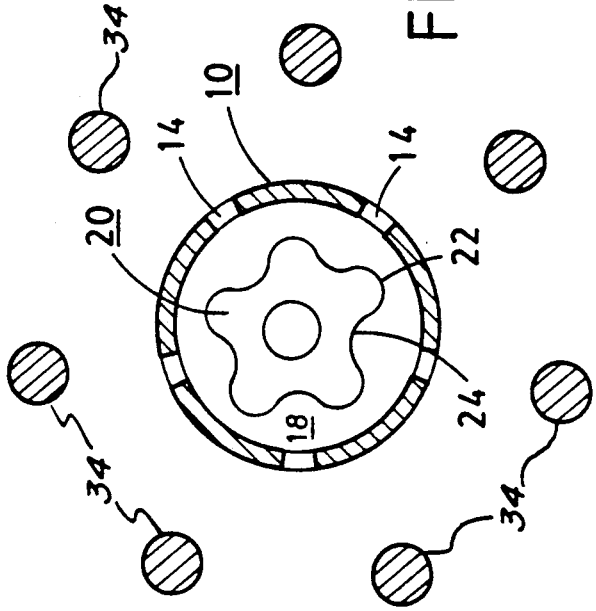
FIG. 10 is a sectional view of a plurality of electroplating anodes and the slotted electroplating shield spaced around the spiral lobe rotor taken along line 10—10 of FIG. 5.

A rotor 20 is electroplated in accordance with the present invention as follows:

(1) the rotor 20 is inserted into the shield hollow 18 as shown in FIGS. 5 and 10;

(2) the shield slots 14 are visually aligned with the rotor valleys 24;

(3) the alignment screws 17 are gently tightened against the bottom of the rotor valleys 24 to temporarily hold the shield 10 in precise alignment with the rotor 20 (see FIG. 6);

(4) the rotor 20 and shield are placed in a suitable support tool (FIGS. 11 and 12) that firmly holds the rotor and shield in the aligned position;

(5) the alignment screws 17 are removed, exposing additional portions of the rotor valleys 24 through the apertures 16;

(6) support tool, the rotor 20, and the shield are immersed in the electrolyte bath adjacent to the anodes; and (7) the rotor 20 is electrically connected as a cathode and plating is begun.

The shield 10 and shield slots 14 compensate for the variation in distance between the anodes and the rotor crests 22 and rotor valleys 24.

With the shield of FIG. 3, it has also been found desirable to double dip the rotor 20 without the shield 10 in order to build up the crests some more as needed to achieve the desired plating thickness. However, this additional electroplating step may be unnecessary with a second preferred shield 10', as shown in FIGS. 13 and 14.

Figure 13:
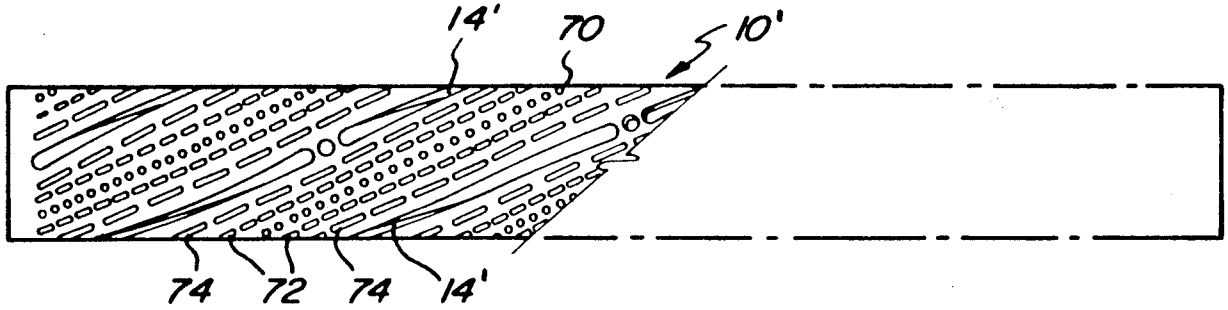
FIG. 13 is a partial elevational view of a second preferred embodiment of an electroplating shield according to the present invention.
Figure 14:
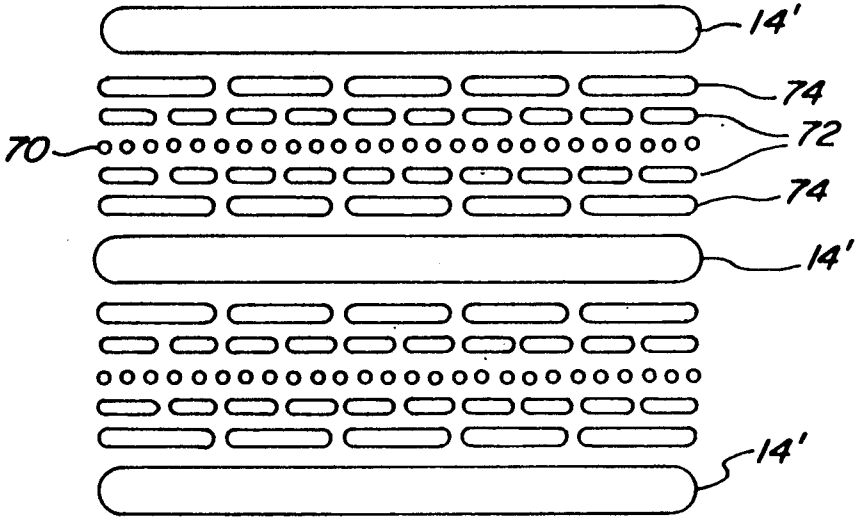
FIG. 14 is a planar representation of the relationship between the slots of varied size carried by the shield of FIG. 13.

As shown in FIGS. 13 and 14, the second preferred shield 10' according to the present invention includes additional apertures 70, 72, 74 between the slots 14 which cover the rotor valleys 24. The additional slots 70, 72, 74 are dimensioned such that they proportionally diminish the exposed area from rotor valley to rotor crest. The plating of the valleys and crests is still controlled with the second preferred shield 10'. However, there is no need to double dip the rotor, because the additional apertures 70, 72, 74 follow in contour and proportionally diminish in size from valley to crest, thus reducing the relative ability for plating to be deposited through them onto the crests, but still allowing sufficient plating to be deposited such that double dipping is unnecessary.

Figure 11:
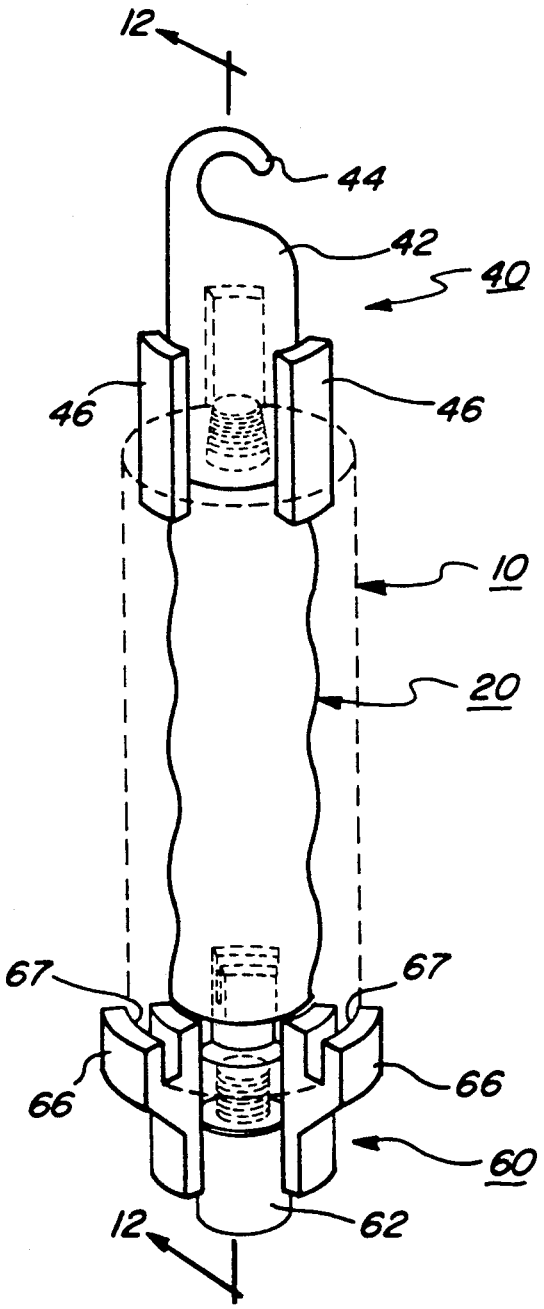
FIG. 11 is a perspective view of a hanging fixture for use with the slotted electroplating shield of the present invention.
Figure 12:
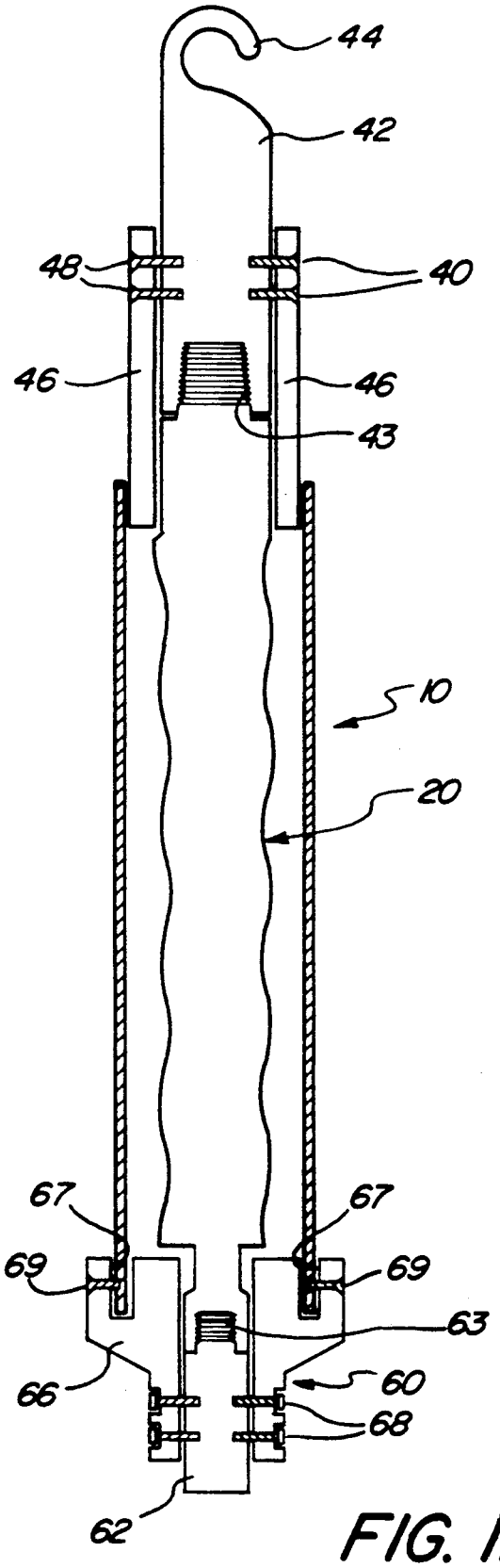
FIG. 12 is a sectional view taking along line 12—12 of FIG. 11.

FIGS. 11 and 12 depict an electroplating hanging fixture comprised of a lower member 60 and an upper member 40. The hanging fixture serves to retain and centralize the rotor 20 and the shield 10 while immersed in the electrolyte bath 32. At least one of the upper member 42 or lower member 62 are preferably comprised of an enhanced electrically conductive material such as beryllium copper, but other electrically conducting materials such as steel are suitable.

As shown, the upper member assembly 40 is comprised of an upper central member 42 having a hook 44 extending therefrom. The hook 44 is used to hang the hanging fixture, the rotor 20, and the shield lo in the electrolyte solution 32. The upper central member 42 has a threaded aperture 43 at its bottom end for threaded engagement with the male side of the rotor 20. The lower member 60 also includes a lower central member 62. The lower central member 62 has a threaded protrusion 63 for threaded engagement with the female side of the rotor 20. Thus, the upper central member 42, the rotor 20, and the lower central member 62 are threaded together and form a vertically integrated unit for suspension within the electrolyte solution 32.

The lower member 60 further includes means for supporting and centralizing the shield 10. In particular, the lower member 60 is comprised of a plurality of wings 66 which, in the preferred embodiment, are securely fastened to the central member 62 with fastener 68. There are preferably three wings 66 fastened about the cylindrical exterior of the lower member 62 at 120-degree increments. The wings 66 include slots 67 in which the shield 10 may be inserted and centralized about the rotor 20. The lower member 60 thus serves as a support and centralizing member.

The upper member assembly 40 includes a plurality of unslotted wings 46 which collectively serve as means for centralizing the shield 10. The wings 46 are fastened to the upper central member 42 with fasteners 48 and are dimensioned such that the central member 42 and wings 46 fit within the inside diameter of the shield 10.

The upper member 40 thus serves to centralize the shield 10 about the rotor 20, but beneficially allows the shield 10 to axially expand such that buckling of the shield 10 does not occur during the electroplating operation.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A mask for uniformly electroplating the surface of an elongate target having a spiralling series of crests and valleys comprising:

an elongate hollow cylindrical mask member being nonconductive and having at least one spiralling aperture therein spatially corresponding to the spiralling valleys of the target; and means for aligning the spiralling aperture of said mask with the spiralling valleys of said target, whereby the spiralling crests and valleys of the target member may be uniformly coated in an electroplating operation.

2. The mask of claim 1 further comprising:

means for holding fast, throughout the plating process, the spatial relationship between said mask and said target.

3. The mask of claim 2 wherein the at least one spiralling aperture of said mask is comprised of a plurality of elongate slots placed end-to-end and said means for aligning comprises a plurality of threaded apertures located between pairs of said elongate slots in said mask and a plurality of screws, one each threaded into said threaded apertures, whereby the at least one spiralling aperture of said mask may be precisely aligned with the spiralling valley of said target by gently tightening said screws against a bottom of said valley and prior to an operation said means for holding fast.

4. The mask of claim 2 wherein said means for holding fast is comprised of an upper member releasably fastened to one end of said target and a lower member releasably fastened to the other end of said target, said lower member including means for fixedly supporting said mask adjacent to said target and said upper member including means for slidably supporting said mask adjacent to said target.

5. The system of claim 4 wherein said means for fixedly supporting said mask is comprised of a central member and at least one wing member connected to said central member, said wing member including a notch in which said mask may rest.

6. A system for uniform electroplating an elongate target member having an irregular surface defined by a plurality of spiralling crests and valleys comprising:

a container of electrolyte, the target member being immersed in the electrolyte and being electrically connected to form a cathode in the electrolyte;

at least one anode immersed in the electrolyte, the anode being spaced from the cathode; and an elongate hollow cylindrical mask member immersed in the electrolyte between the anode and the cathode, the mask member including a first plurality of spiralling apertures that substantially spatially correspond to the spiralling valleys of the irregular surface of the target member, whereby the spiralling crests and valleys of the target member may be uniformly coated in an electroplating operation.

7. The system of claim 6 wherein said mask member further includes a second plurality of apertures, said second plurality of apertures being substantially parallel to said first plurality of apertures and diminishing in size from valley to crest.

8. The system of claim 7 wherein said second plurality of apertures also increase in frequency from valley to crest.

9. The system of claim 6 further comprising means to align said first plurality of spiralling apertures with said spiralling valleys of the target.

10. The system of claim 9 further comprising means to hold fast said mask member and said target in an aligned position during the plating process after said first plurality of spiralling apertures and said spiralling valleys have been aligned.

11. The system of claim 10 wherein said target member is a spiral lobe rotor having at least one spiralling valley and at least one spiralling crest;

said mask member is sized to fit around said spiral lobe rotor; and said means to hold fast is comprised of an upper member releasably fastened to one end of said spiral lobe rotor and a lower member releasably fastened to the other end of said rotor, said lower member including means for supporting and centralizing said mask member about said spiral lobe rotor and said upper member including means for slidably centralizing said mask member about said spiral lobe rotor.

12. The system of claim 11 wherein said means for slidably centralizing is comprised of a central member and a plurality of wing members arranged about said central member, said central member and said plurality of wing members being sized to fit within said mask means.

13. The system of claim 11 wherein said means for supporting and centralizing said mask means is comprised of a central member and a plurality of wing members arranged about said central member, each of said wing members including a notch in which said mask means may rest.

14. An electroplating mask for uniformly plating a spiral lobe rotor having at least one spiralling valley and at least one spiralling crest, said electroplating mask comprising:

an elongate hollow cylindrical mask member comprised of a wall and being sized to fit around the rotor; and at least one aperture spiralling about the wall of said hollow cylindrical member and spatially corresponding to said at least one spiralling valley, whereby the spiralling aperture of said mask member may be aligned with the spiralling valley of said spiral lobe rotor to evenly coat the crests and valleys of said spiral lobe rotor in an electroplating operation.

15. The electroplating mask of claim 14 wherein said aperture is comprised of a single spiralling longitudinal aperture.

16. The electroplating mask of claim 14 wherein said aperture is comprised of a plurality of longitudinal apertures, located end-to-end one after the other.

17. The electroplating mask of claim 16 further comprising means for aligning the apertures of the electroplating mask with the valleys of the rotor.

18. The electroplating mask of claim 17 wherein the means for aligning comprises:

a plurality of threaded apertures interposed between the longitudinal apertures, and a plurality of screws, one each threaded into said threaded apertures.

* * * * *